US006601558B2

(12) United States Patent
Clements

(10) Patent No.: US 6,601,558 B2
(45) **Date of Patent: *Aug. 5, 2003**

(54) CYLINDER HEAD CONFIGURATION

(76) Inventor: Michael L. Clements, 1853 E. Arabian Dr., Gilbert, AZ (US) 85296

( * ) Notice: Subject to any disclaimer, the term of this patent is extended or adjusted under 35 U.S.C. 154(b) by 0 days.

This patent is subject to a terminal disclaimer.

(21) Appl. No.: 10/016,150

(22) Filed: Dec. 10, 2001

(65) Prior Publication Data

US 2002/0046726 A1 Apr. 25, 2002

Related U.S. Application Data

(63) Continuation-in-part of application No. 09/571,079, filed on May 15, 2000, now Pat. No. 6,328,012.

(51) Int. Cl.[7] ..... F02F 1/18

(52) U.S. Cl. ..... 123/193.5; 123/188.3; 123/189

(58) Field of Search ..... 123/193.5, 188.14, 123/188.3, 189, 188.4; 29/888.01, 888.06

(56) References Cited

U.S. PATENT DOCUMENTS

| | | | | |
|---|---|---|---|---|
| 1,218,317 A | | 3/1917 | Rich | |
| 1,250,463 A | | 12/1917 | Hutchinson | |
| 1,252,501 A | | 1/1918 | Shepard | |
| 1,318,227 A | | 10/1919 | Nyhagen | |
| 1,360,536 A | | 11/1920 | Kelly | |
| 1,443,911 A | | 1/1923 | Burtnett | |
| 1,608,020 A | | 11/1926 | Grace | |
| 1,680,099 A | | 8/1928 | Gray | |
| 1,749,552 A | | 3/1930 | Warren | |
| 1,759,425 A | | 5/1930 | Suekoff | |
| 1,777,792 A | | 10/1930 | Grace | |
| 1,784,555 A | | 12/1930 | Summers | |
| 1,804,873 A | | 5/1931 | Hoffman | |
| 1,856,348 A | | 5/1932 | McMillan | |
| 1,910,813 A | | 5/1933 | Powell | |
| 1,922,678 A | | 8/1933 | Hallet | 123/188 |
| 1,942,648 A | | 1/1934 | Jensen | 123/188 |
| 2,080,126 A | | 5/1937 | Gibson et al. | 123/188 |
| 2,111,601 A | | 3/1938 | Rabezzana et al. | 123/191 |
| 2,201,292 A | | 5/1940 | Hickey | 123/75 |
| 3,136,305 A | * | 6/1964 | Kenworthy | 123/65 V |
| 3,916,866 A | | 11/1975 | Rossi | 123/197 R |
| 3,924,582 A | | 12/1975 | Yagi et al. | 123/32 SP |
| 4,344,408 A | | 8/1982 | Inoue et al. | 123/661 |
| 4,745,891 A | | 5/1988 | Cola | 123/193 |
| 5,269,210 A | | 12/1993 | Johnson | 82/47 |
| 5,295,462 A | * | 3/1994 | Barnes et al. | 123/193.5 |
| 5,320,075 A | | 6/1994 | Regueiro | 123/310 |
| 5,605,125 A | | 2/1997 | Yaoita et al. | 123/175 |
| 6,435,153 B1 | * | 8/2002 | McAliece et al. | 123/193.3 |

FOREIGN PATENT DOCUMENTS

| | | |
|---|---|---|
| GB | 22408 | 5/1911 |
| GB | 24989 | 11/1911 |
| GB | 274523 | 9/1912 |

* cited by examiner

*Primary Examiner*—Tony M. Argenbright
*Assistant Examiner*—Katrina B. Harris
(74) *Attorney, Agent, or Firm*—Douglas W. Rudy

(57) ABSTRACT

A cylinder head assembly for use in a flat head style internal combustion engine. A valve for use in the head has a cup portion above the face of the valve. The cup portion of the valve moves longitudinally in a sleeve or liner in the head of the engine.

9 Claims, 6 Drawing Sheets

FIG. 1
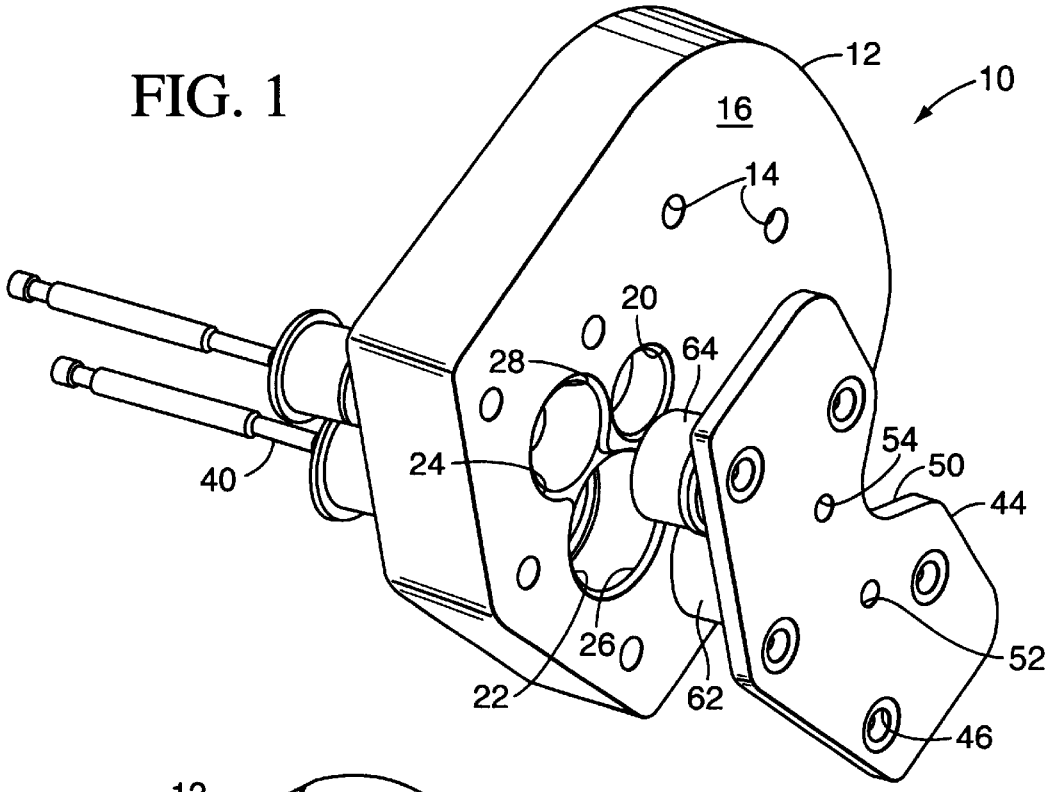
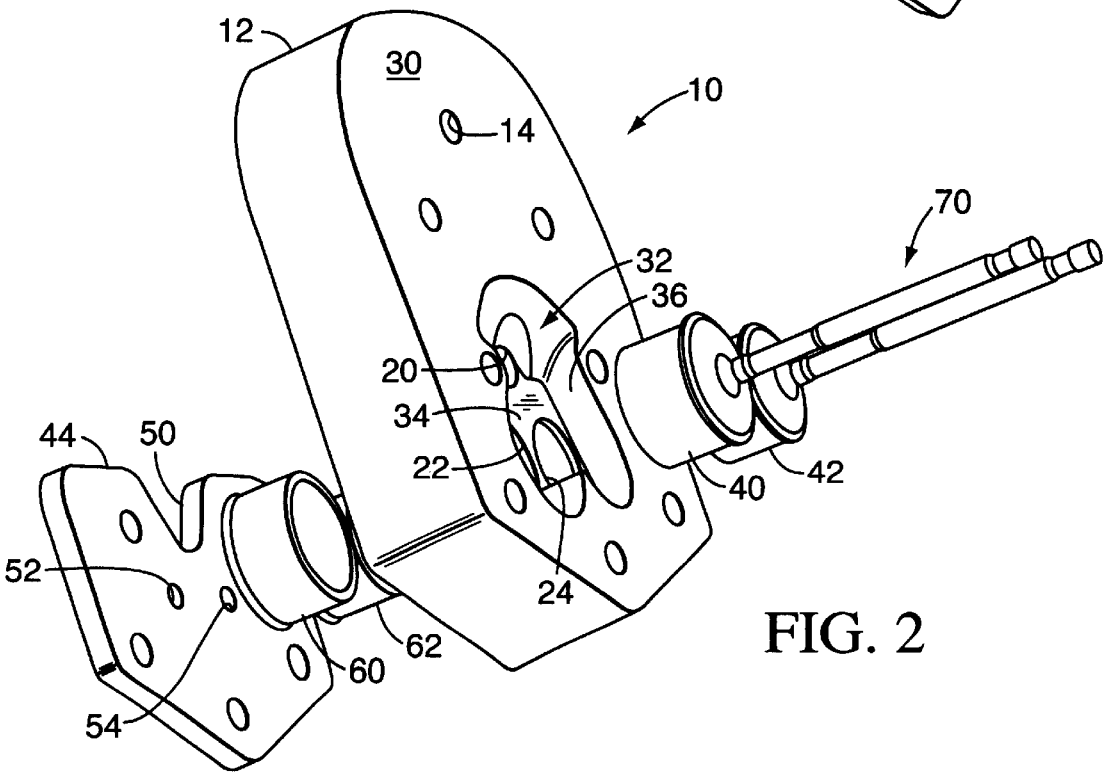
FIG. 2

CYLINDER HEAD CONFIGURATION

CROSS REFERENCE TO RELATED APPLICATION

This application is a continuation-in-part of application Ser. No. 09/571,079, now U.S. Pat. No. 6,328,012.

BACKGROUND OF THE INVENTION

1. Field of the Invention

This invention pertains to a cylinder head configuration and to shapes for use in the cylinder head. The application is for use in intake and exhaust valve configurations flat head engines. The combustion chamber shape and gas flow through the combustion chamber results in an increase of combustion efficiency, a reduction of hydrocarbon emissions and an increase in compression ratio.

2. Description of the Related Art

It has been known to provide four cycle engines with side valve, "L-head" or flat head type cylinder heads with integral combustion chambers, hereinafter "flathead" engines. The flat head engine has a head with a cavity formed in it. This cavity provides the combustion chamber for the engine.

A combustable fluid, such as a mixture of air and fuel, is directed to the combustion chamber through an intake valve. An exhaust valve allows spent gasses through a passage to an exhaust manifold and the exhaust is thus evacuated from the combustion chamber.

The flat head engine was in widespread use through the 1950's, including automotive use, for many years but has been superceded in many applications by overhead valve engines. The flat head engine is widely used, however, in small displacement four cycle engines with one or two cylinders. Typical applications for four cycle flat head engines are found in gas operated lawn mowers, electric generator power systems, snowblowers, weed trimmers, lawn edgers, go kart motors, boat engines and the like.

There have been many intake/exhaust/valve configurations in the development of the flat head engine. Many of these valve configurations use slide valves, shuttle valves or poppet valves.

For instance, a flat head engine with a poppet valve configuration is shown in U.S. Pat. No. 1,784,555. A slide type valve, a piston type valve and a sleeve type valve are shown in U.S. Pat. Nos. 1,856,348; 1,680,099 and 1,922,678. None of these patents show the valve configuration presented herein.

The age of these patents and the paucity of modern day patents concerning valve systems for flat head engines show that there has been a dearth in the generation of ideas relating to flat head engines. This invention is directed to a system that makes the four cycle flat head engine more competitive with the overhead valve and overhead camshaft engines in vogue and being developed today. The overhead valve engines are more expensive to produce than the flat engine and there are great advantages in production economics if an improvement can be made in the efficiency and especially in reducing hydrocarbon emissions of the flat head engine.

One advantage of this invention is that hydrocarbon emissions are reduced to the point where small engine manufacturers can produce a clean burning engine without having to resort to an overhead valve configuration to get equivalent hydrocarbon emissions.

SUMMARY OF THE INVENTION

The invention is a cylinder head for use and a flat head type four cycle engine. A combustion chamber is formed in the head. A poppet valve having a cup shaped extension extending from the face of the valve will move into and partially through the combustion chamber in order to allow gas to enter and exit the combustion chamber.

The cup of the valve will move into and out of a recess formed in the cylinder head in line with the valve. The cup surface and the valve cup receiving recess will be a sealed sliding fit so that the valve cup displacement does not affect the volume of the combustion chamber.

The valve cup eliminates the need for a displaceable volumn above the valve faces in the combustion chamber allowing better use and configuration of the combustion chamber.

In one embodiment of the invention the valve cup receiving recess is provided with a liner bore to line the recess. This allows the use of alternative sealing structures, metal compounds and modifications to valve sizing when using a standard head for engines with a choice of valve diameters.

One object of this invention to increase the efficiency of an internal combustion engine and decrease the hydrocarbon emissions of such engine.

Another object of this invention to increase the compression ratio of an engine.

It is also an object of this invention to provide a valve system that can be installed on a contemporary engine without significant engine modification.

It is also an object of this invention to provide a lightweight valve cup.

Another object of this invention to provide a two piece valve system with a valve having cup portion.

A further object of this invention to provide a construction of a valve stem and cup valve using friction welding.

It is another object of the invention to provide a removable access cover on a head of a flat head engine.

It is also an object of the invention to provide communication from the face of an intake valve to the face of an exhaust valve.

The preferred embodiments of the invention presented here are described below in the drawing figures and Detailed Description of the Invention. Unless specifically noted, it is intended that the words and phrases in the specification and the claims be given the ordinary and accustomed meaning to those of ordinary skill in the applicable arts. If any other special meaning is intended for any word or phrase, the specification will clearly state and define the special meaning.

Likewise, the use of the words "function" or "means" in the Detailed Description of the Invention is not intended to indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically state the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to invoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, material or acts for performing the claimed function.

BRIEF DESCRIPTION OF THE DRAWINGS

The features of the invention is described in detail below by way of example in which the drawings include:

FIG. 1 an expanded, projected, top view of a cylinder head and associated valves;

FIG. 2 is an expanded, projected bottom view of the cylinder head and associated valves shown in FIG. 1;

DETAILED DESCRIPTION OF THE INVENTION

Figure 3:
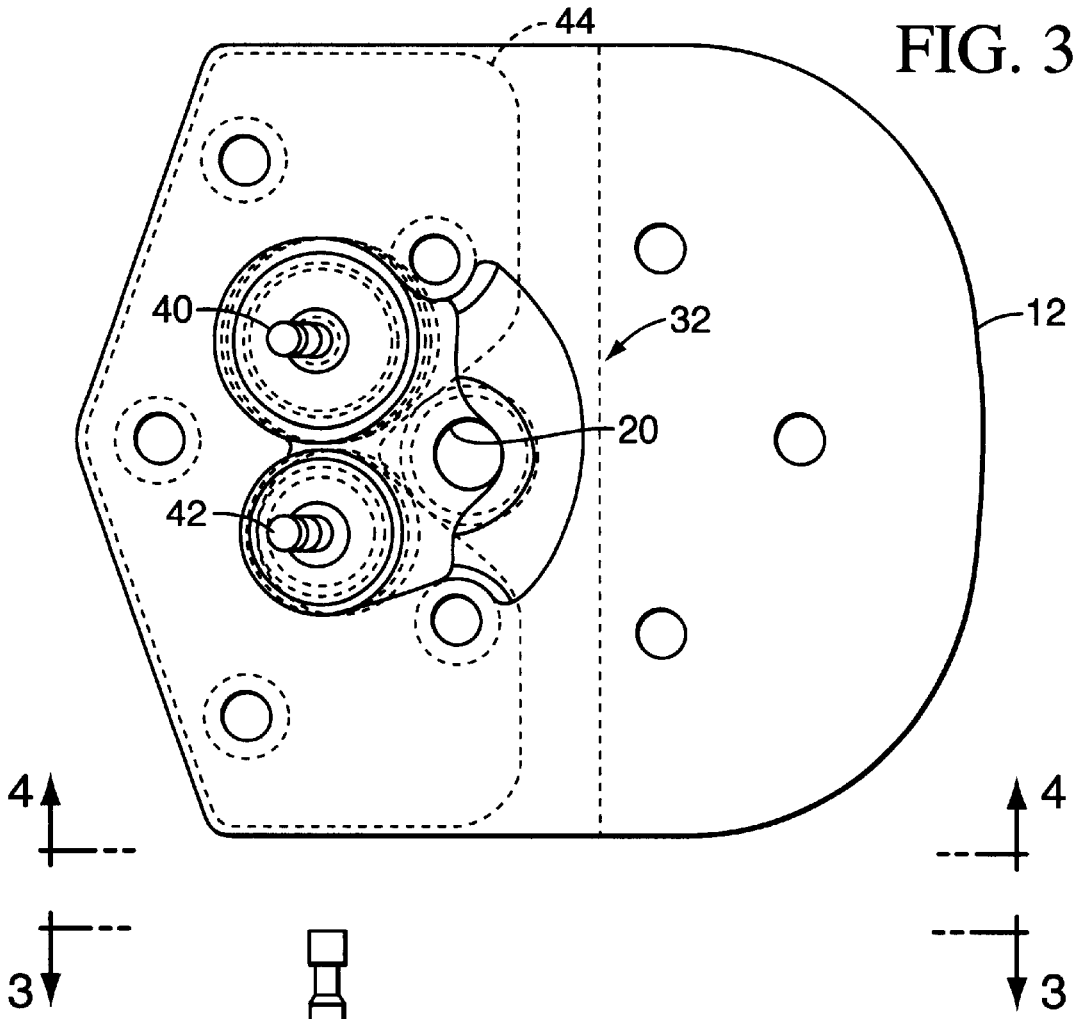
FIG. 3 is the bottom view of the unexpanded cylinder head shown in FIG. 1.

The invention is a cylinder head for use on a four stroke poppet type internal combustion engine. The inventor contemplates various embodiments of the invention and the configuration of a preferred embodiment and several alternative embodiments are set forth herein.

One embodiment is shown in FIGS. 1 and 2. In these views the cylinder head and valve assembly generally 10, includes a head 12. The head 12 is for attachment to an engine block (not shown) using fasteners that will pass through holes in the head such as through bore 14. The head 12 is generally a monolithic block of material, such as aluminum, steel or iron that can be machined from billet stock, cast and machined, or otherwise formed in a conventional manner. Although shown as a generally flat surfaced structure it would not be unusual to have cooling fins integrally cast or machined into the head for heat dissipation and the control of heat buildup.

The top side 16 of the head 12 includes a through bore 20 that is a spark plug receiving hole. It will be threaded to accommodate a spark plug or other ignitor.

An intake valve accommodating bore ("intake bore") 22 is machined through the head. Likewise an exhaust valve accommodating bore ("exhaust bore") 24 is also machined or formed in the head 12. Each of these bores can be cast-in-situ bores or machined bores, either a machined casting or a completely machined bores depending on designer preference and whether or not the bore is sleeved as will be discussed further on in this specification.

As shown in FIG. 1, bores 22 and 24 may include recesses 26 and 28 respectively. These recesses may be fully circumferential (not shown) depending on the relative location of the intake and exhaust bores 22 and 24. Alternatively, as shown in FIG. 1, the recesses can be discontinuous or actually meld into a non-circumferential zone as shown.

Turning to FIG. 2, the relative bottom side 30 of the head 12 can be clearly seen. Here the through holes such 14, the spark plug bore 20, the intake bore 22, and the exhaust bore 24 are shown. The combustion chamber, generally 32, is a cavity machined or otherwise formed as a depression in the surface of the head surface bottom side 30. The combustion chamber includes a roof 34 and other features such as a Regeneral formed in the chamber surrounded by walls such as 36.

Shown in FIGS. 1 and 2 and more clearly in FIG. 2 are an intake valve 40 and an exhaust valve 42. They will be discussed in detail further on in this disclosure.

A retainer plate 44 is provided to cover the intake bore 22 and exhaust bore 24. This retainer plate includes a number of through bores, such as head bolt bores 46, five shown, as well as a relief zone 50 that allows access to the spark plug bore 20 so that a spark plug can be inserted easily into the spark plug bore 20.

In one embodiment of the invention a pair of bleed holes, intake bleed hole 52 and exhaust bleed hole 54, are provided. In another embodiment, these two bleed holes, 52 and 54 can connected by a tube.

As shown most clearly in FIG. 2, an intake bore liner ("intake liner") 60 and an exhaust bore liner ("exhaust liner") 62 are shown. These are designed to fit into the respective intake 22 and exhaust 24 bores and will be held in place in the bores by contact with the retainer plate 42. The interior of the intake liner 60 and the interior of the exhaust liner 62 will line up with the intake bleed hole 52 and the exhaust bleed hole 54, respectively, when such bleed holes are used in a particular embodiment.

The detail structure of the intake 40 and exhaust 42 valves can best be appreciated by perusing FIGS. 5–8.

Each of the valves are similar in construction so only the intake valve will be described. The exhaust valve is virtually identical, the only difference in a preferred embodiment is that the intake valve has a larger diameter in the cup portion and at the face of the valve.

The valve may be assembled from two components. It will include a valve stem, generally 70 and a valve cup, generally 72. The stem may include a valve guide surface 74, a cam or tappet contacting end 76 and a valve head attachment end 80.

The head of the valve, the valve cup 72, is friction welded, or otherwise affixed to the valve stem 70. Of course, an alternative embodiment would be to construct the valve of one piece, however, it is not unusual to have two piece valve assemblies as shown in FIGS. 5–8.

Figure 7:
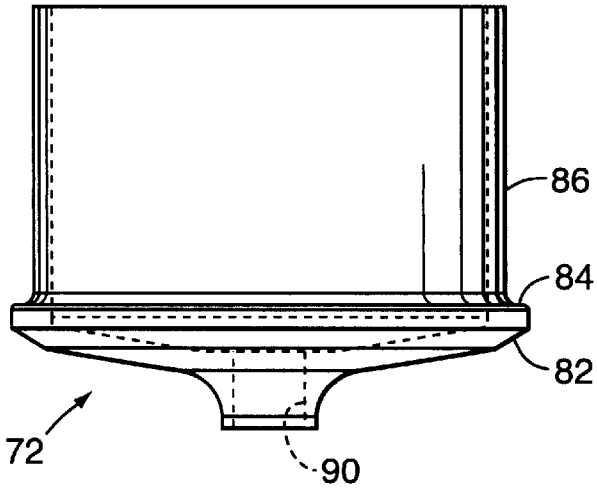
FIG. 7 is a side elevation view of a valve cup.
Figure 6:
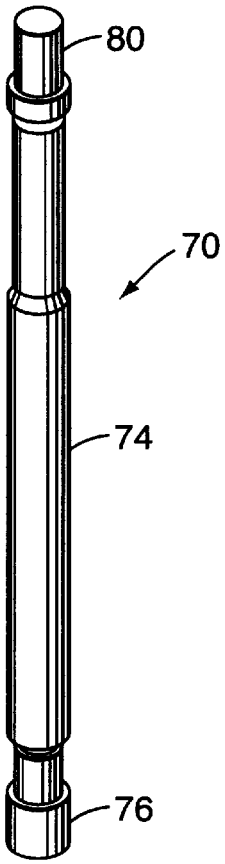
FIG. 6 is an orthographic projection of a valve stem of the cup valve of FIG. 5.
Figure 8:
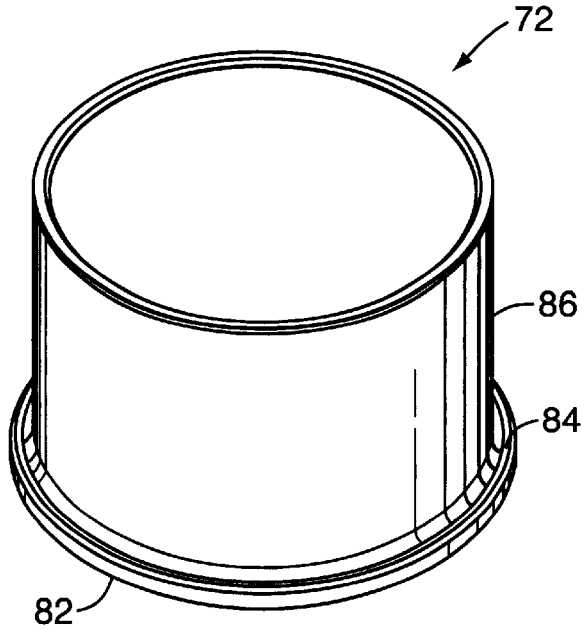
FIG. 8 is an orthographic projection of the cup or head of the valve of FIG. 5.

The valve cup 72 includes a head portion as shown in FIGS. 7 and 8 that has a machined sealing surface 82 on the stem side of the valve cup. The normal face surface 84 supports a, circumferential wall 86. This wall, hereinafter sometimes referred to as a "cup," is fixedly attached to the normal face surface 84 of the valve. The attachment can be by friction welding; welding, adhesive, or the like; or alternatively, the wall can be formed integrally with the head of the valve or with a one piece valve.

As shown in FIG. 7 the underside of the head portion of the valve has a stem receiving bore 90 into which the valve head attachment end 80 will be inserted. These components will be friction welded together or otherwise fixedly attached—stem to valve head.

The wall of the cup 86 is relatively thin, in a preferred embodiment, in order to keep the mass of the valve low. It could, however, include a filled or partially filled interior if desired. As shown in the dotted line representation of FIG. 7 some of the face surface of the valve inside the wall of the cup 86 has been machined away—again for weight reduction and, to some extent, heat dissapation considerations.

Figure 9:
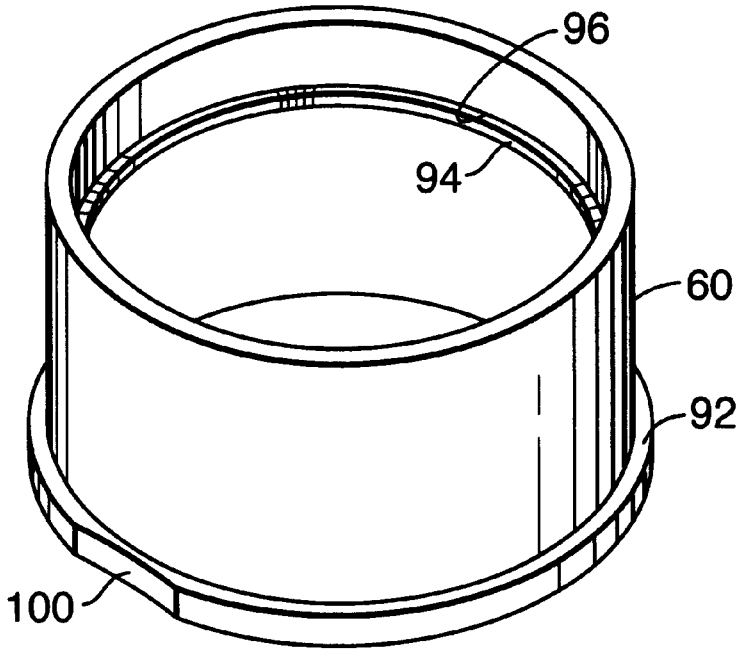
FIG. 9 is an orthographic projection of an intake or exhaust value bore liner.
Figure 10:
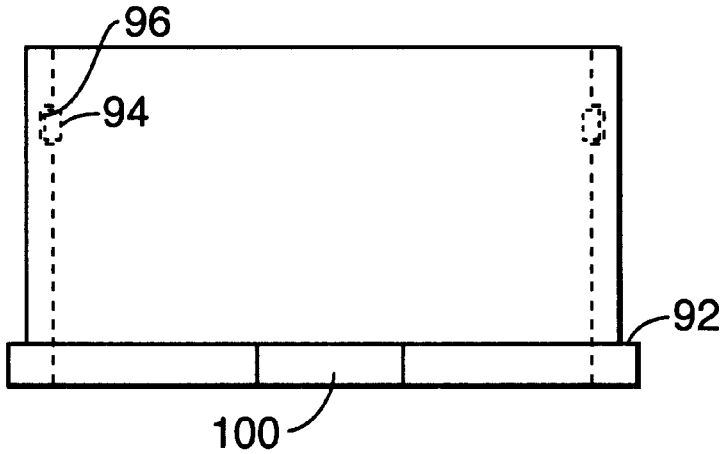
FIG. 10 is a side elevation view of the liner shown in FIG. 9.

FIGS. 9 and 10 illustrate a preferred embodiment of an intake liner 60. The exhaust liner 62 is virtually identical other than size so the intake liner 60 will be described. Shown in FIGS. 9 and 10 is an open ended cylindrical element having a retainer flange 92 sized to fit into the intake bore recess 26 of FIG. 1. This flange to recess relationship will position the intake liner 60 into the intake bore 22 and prevent the liner from going too deep into the combustion chamber.

The interior dimension of the liner is just slightly larger than the outside diameter of the cup of the valve. A very effective seal is insured by the optional or alternative embodiment use of a piston ring 94 carried in a ring groove 96 of the intake liner 60.

As the exhaust liner 62 and the intake liner 60 may be spaced closely together on the head it may be necessary, and is one embodiment presented here, to machine a flat 100, in the retainer flange 92. These two flats, one on the intake liner and one on the exhaust liner, will abut each other and not only allow clearance so that both liners can be properly seated but will also tend to reduce liner rotation in the respective intake and exhaust bores.

The liner material may be metal or a composite material having the thermal requirements necessary for performing the liner function.

Figure 4:
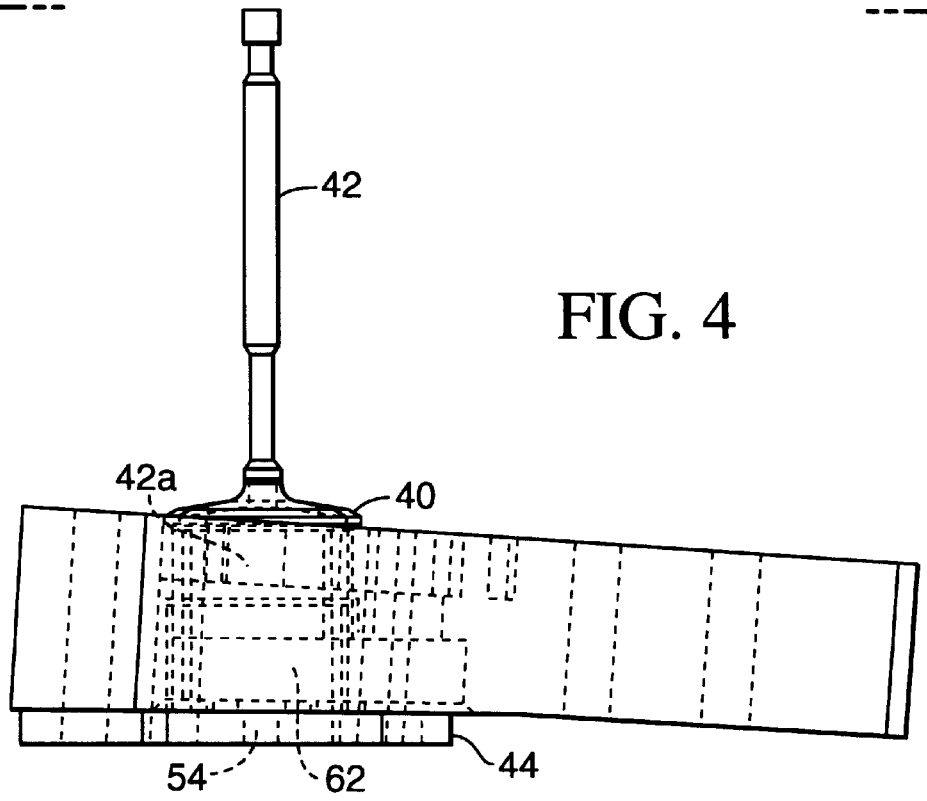
FIG. 4 is a side elevation view of the assembled cylinder head shown in FIG. 3.
Figure 5:
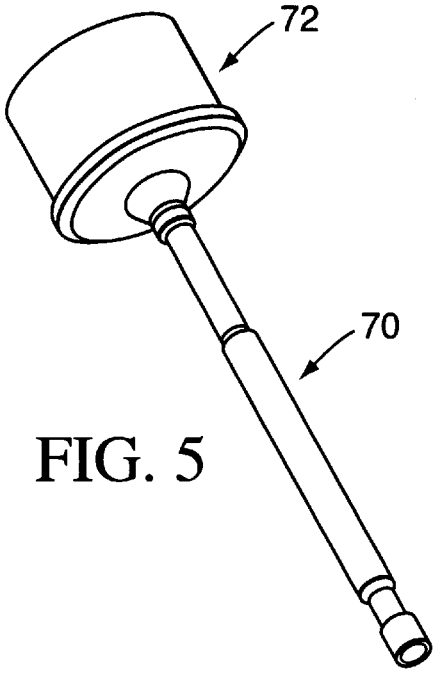
FIG. 5 is an cup valve assembly.

All the salient elements of the head and valves can be seen incorporated into FIGS. 3 and 4. FIG. 3 is a bottom side view of a head and valve assembly showing the head 12, the combustion chamber 32, the intake valve 40, the exhaust valve 42 and the retainer plate 44. No spark plug is inserted in the spark plug hole 20.

Similarly FIG. 4 shows the exhaust valve 44, a portion of the intake valve 40, the head 12, the retainer 44, the exhaust liner 62, a bleed hole 54, and the cup portion 42*a* of the exhaust valve 42.

The reason for the cup portion on the intake and exhaust valves is to increase the efficiency of the combustion process and ultimately reduce hydrocarbon exhaust emissions. What is done with this invention is an increase in compression ratio without hindering airflow in a four cycle flat head engine. The tall margin on the intake and exhaust valves, the cup circumferential walls such as 86 of the intake valve, 40 for instance, when on the valve seats during the compression and power strokes, will occupy space in the combustion chamber 32 thus effectively reducing the overall volume of the cylinder head. The volume taken up by the cylindrical volume of the cups of the intake and exhaust valves and was not located in the combustion chamber so as to enhance the flame front or combustion process in the chamber. With inefficient combustion due to the volumn above the values being part of the combustion chamber, pockets of unburned hydrocarbons would develop. Unburned hydrocarbons present serious emission problems.

The operation of the valves follows: Starting with both valves closed, the cup portion of each valve will displace a certain volume of space in the combustion chamber. As a valve moves off its seat the cup portion will move into the liner or bore location above the valve. This allows intake gasses to enter the combustion chamber. With the gas/air mixture in the compression chamber the valve head, including the cup portion, will move partially out of the inlet bore or bore liner and the cup portion of the valve will fill a given volume of the combustion chamber. The valve will occupy the space in the combustion chamber that, in a conventional flat head engine, is part of the combustion chamber—unfortunately directly above a valve in an undesirable zone of the combustion chamber.

This process is repeated on the exhaust stroke as well. On the intake and exhaust strokes, the cups (the tall margins) of the valves, are guided up and out of the path of the incoming and outgoing gasses. The cup portion of the valve "hides away" in the intake and exhaust bores formed in the cylinder head.

Another embodiment of the invention consists of a one piece, cast, machined from billet, stamped, or otherwise formed, cylinder head element that incorporates the tall valve relief cylinders without the need for a retainer plate. This cylinder head embodiment, most efficiently a one piece design, but not limited to a one piece in its execution, construction, or formation, is a replacement for conventional valve in block cylinder heads already in the field. This would include a vast number of small engines such as, but no limited to, those used on lawn movers, generators, go-karts, and the like. It is expected that in mass production, where high volume and low production cost are important to a manufacturer, a cylinder head of the set forth design, not including a retainer plate for instance, will be appreciated by the manufactures' giving them the ability to have the advantages of an economical and environmentally superior product. Expected improvements would include, but not be limited to, lower exhaust emissions, higher horsepower ratings and fuel savings.

Figure 11:
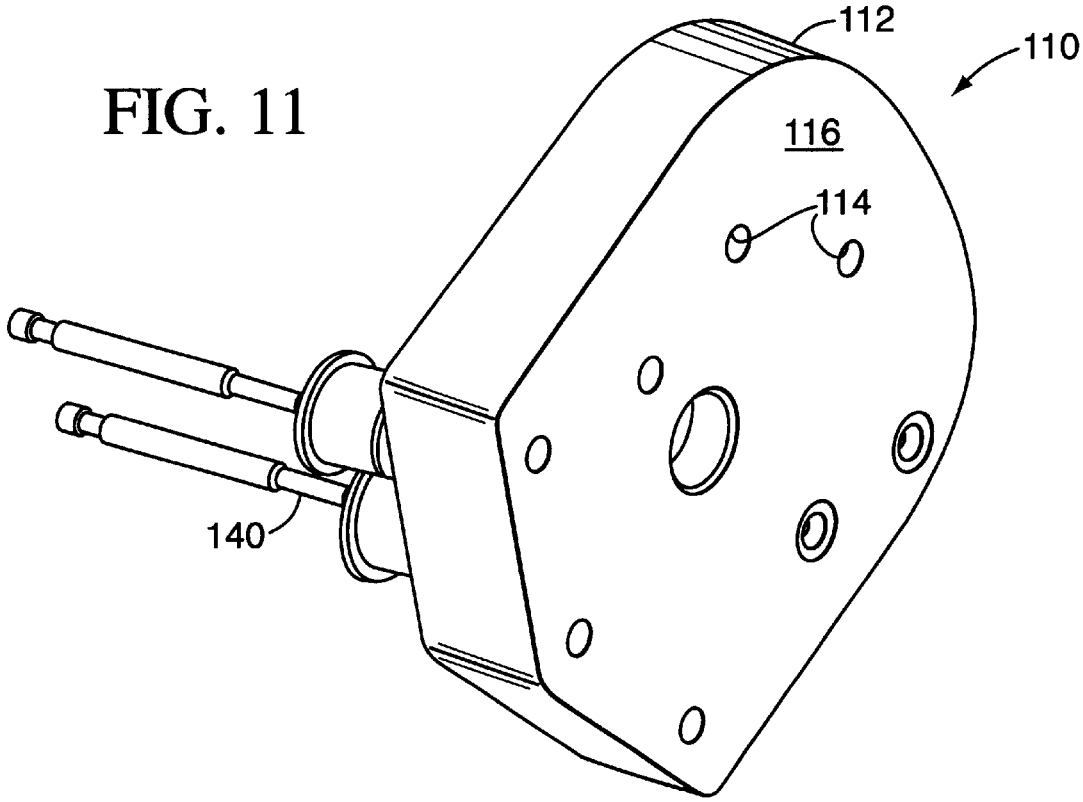
FIG. 11 is an expanded, projected top view of an alternative embodiment of a cylinder head.

FIG. 11 shows an alternative embodiment of the invention. In this figure the head, generally 102, is made of a monolithic block of material such as 112 having an outer surface 116 and including through bores such as 114. The head 102 is cast; formed from a billet of metal or appropriate material such as carbon fiber or other material adequate for use as cylinder head material; or otherwise fabricated, such as by molding, forming or forging, for instance. The cylinder head 112 includes a cavity, shown in FIG. 12 as item generally 132, formed as a depression on the bottom side of the head. One intake valve 140 accommodating bore, also shown in FIG. 12 as 122, is formed in the head in this embodiment however it is contemplated that more than one intake valve can be used in each cylinder thus there would be more than just one valve accommodating bore in the head. Likewise, for the exhaust valve 144, shown in FIG. 12 as 142 juxtaposed its accommodating bore 124 that is formed in the cylinder head 112. One exhaust valve 142 is shown in FIGS. 11 and 12, however more than one valve accommodating bore, where an engine has more than one exhaust valve per cylinder, is contemplated.

A liner can be used, but in FIG. 11 is not shown, in each of the intake and in the exhaust valve bores 122 and 124 respectively. The liners give the engine designers and tuners the ability to use one head casting or configuration to accommodate different size valves without having to machine the head itself.

Figure 12:
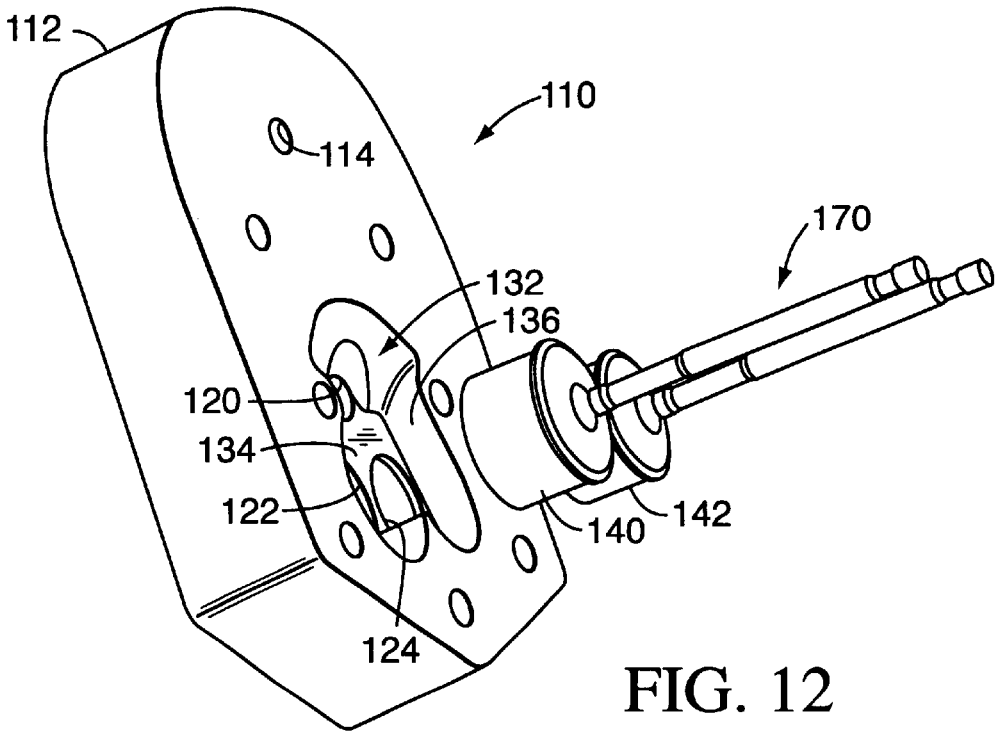
FIG. 12 is an expanded, projected bottom view of the alternative cylinder head shown in FIG. 11 and associated valves shown in FIG. 11.

FIG. 12 shows the bottom or inner side of the cylinder head. Here the cavity, generally 132, is seen. The bore 120 for the spark plug and the bores 122 and 124 for the intake 140 and exhaust 142 portions of the valves generally 170 are also in view. Through bores, such as 114, in the mass of the head allow passage of head attachment fasteners (not shown) that enable head bolts to hold the cylinder head in position on the supporting block of the engine.

Figure 13A:
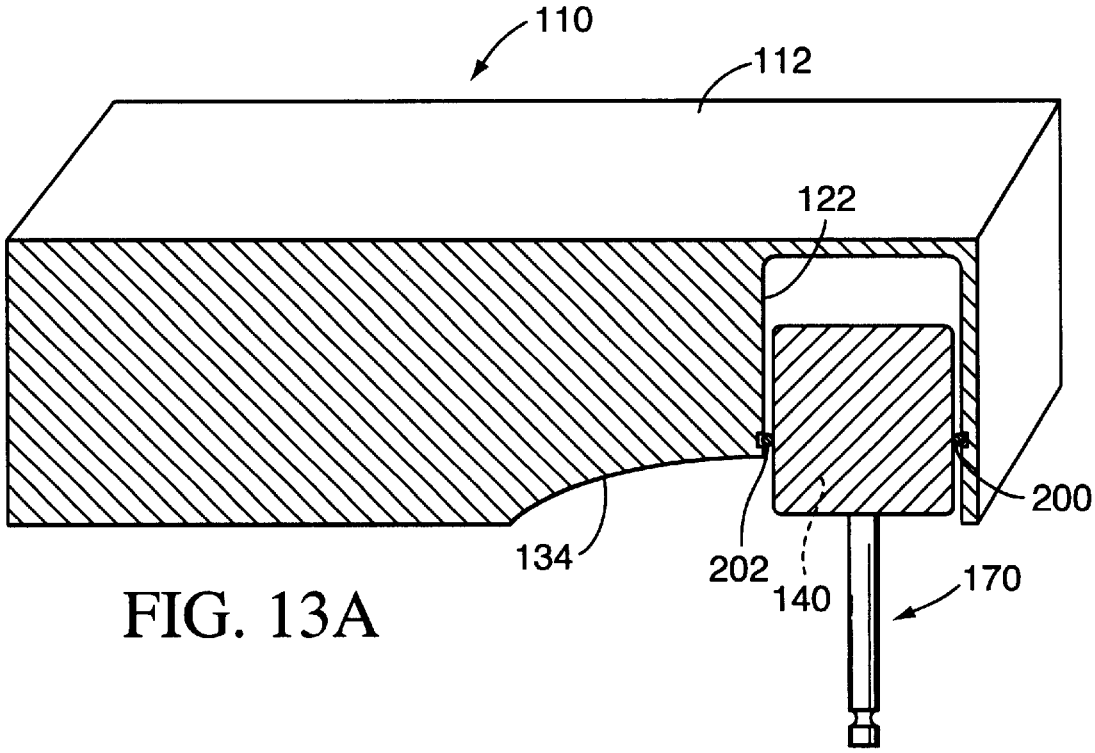
FIGS. 13A and B show a cross section view of a cylinder head with emphasis on a sealing internal piston ring.
Figure 13B:
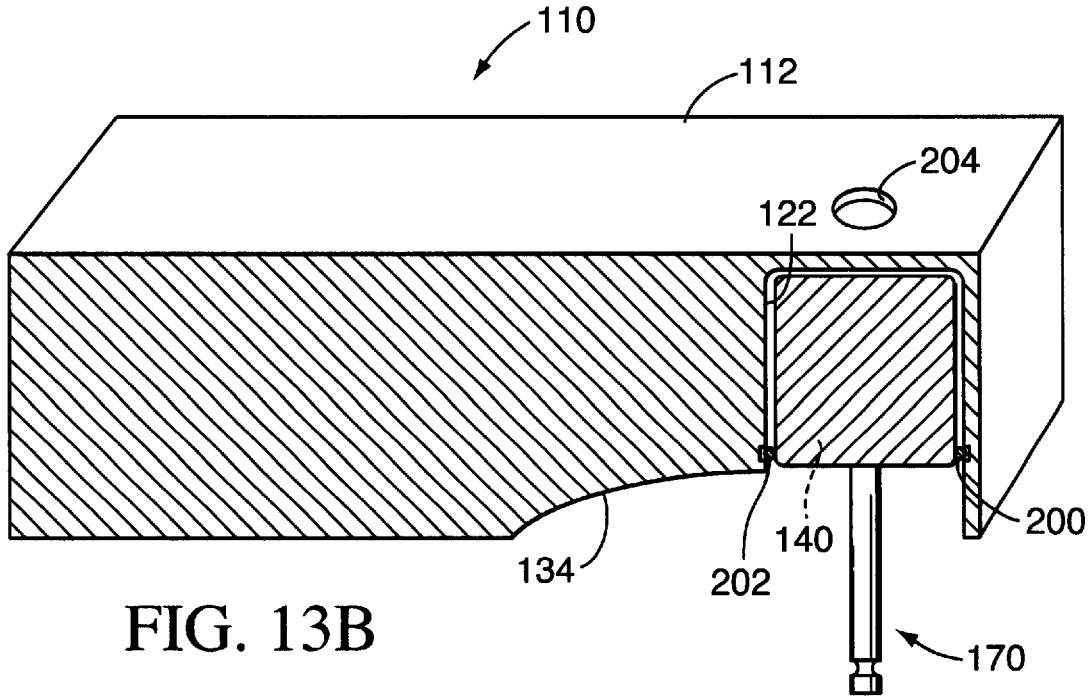

FIGS. 13A and 13B show a cross section of a schematic cylinder head generally 110 as shown in FIGS. 11 and 12. In FIGS. 13A and B the mass of the cylinder head 112 has a bore for each intake and exhaust valve formed therein as shown as 122 for a representation of the intake valve bore. The bore 122, and the exhaust bore, not shown in these views, is provided with a recess 202 to contain an internal piston ring 200. The internal ring 200 will seal the margin between the outer surface of the valve 140 and the internal surface of the bore 122 as the valve moves in and out of the bore 122.

An alternative embodiment of the invention may include a port such as 204 as shown in FIG. 13B. This port is an alternative embodiment and may be left out, and in a more preferred embodiment, would be left out, of the FIG. 13B structure. The port can be used as a pressure and/or vacuum source if it is provided. Also, the port is shown proximate the intake bore but it is also contemplated that a port could be used proximate and in communication with an exhaust port. Again, this is simply an alternative embodiment and not required for full activity of the structure shown in FIGS. 11, 12, 13A and 13B.

The embodiments disclosed above are the preferred embodiments of the invention however, there are modifications and alternatives that may be desirable in certain circumstances. For instance, it is possible to practice the invention without the use of the intake and exhaust liners. The bores will just be machined in the head above the valves with a good surface finish and possibly a piston ring groove to accept an internal piston ring.

Another alternative is to make the liners out of carbon fiber for good wear and heat dissipation.

Also it may be found that very good operating results, or at least adequate results, can be achieved by using only a single valve with the cup configuration and the other valve with a conventional head. Of course more than two valves per cylinder are possible.

Another option is to have the bleed holes in the retainer plate quite large to reduce any airflow impediments. Alternatively a bleed passage from the intake liner bore to the exhaust liner bore (or just the bores where liners are not used) performing the same act, as the tube from the bleeds mentioned above, is a possibility.

Various of the features, subcombinations and combinations of this invention can be practiced with or without reference to other features, subcombinations and combinations of the invention, and numerous adaptations and modifications can be effected within the spirit of the invention. While particular embodiments of the invention have been shown and described, it will be obvious to those skilled in the art that changes and modifications may be made without departing from the invention in its broader aspects, and, therefore, the aim in the appended claims is to cover all such changes and modifications as fall within the spirit and scope of the invention and the following claims. For instance, in the liners it may be desirable to have more than a single sealing ring, thus the use of multiple rings is contemplated as is the positioning of the rings in the liner or on the cup of the valve. In addition, for instance, the cup of the valve can be made of different materials or filled with different materials, such as various metals, plastics, fiberglass or other similar materials. Such design nuances are contemplated as being within the scope of the invention and intend to be covered by these claims.

What is claimed is:

1. A cylinder head for accommodating an intake valve and an exhaust valve, each valve having a circumferential wall, the cylinder head having a head surface bottom side and comprising:

a cavity formed as a depression in the head surface bottom side;

an intake valve accommodating bore formed in the cylinder head, the bore capable of accommodating the circumferential wall of the intake valve;

an exhaust valve accommodating bore formed in the cylinder head, the bore capable of accommodating the circumferential wall of the exhaust valve.

2. The apparatus in accordance with claim 1 further comprising an intake bore liner for fitting into the intake valve accommodating bore;

an exhaust bore liner for fitting into the exhaust valve accommodating bore.

3. The apparatus in accordance with claim 2 wherein the intake bore liner and the exhaust bore liner have an outer diameter similar to the diameter of the respective intake and exhaust valve accommodating bores and the inner diameters of the intake and exhaust bore liners are sized to accommodate the intake and exhaust valve circumferential wall outside diameters as may be selected for use.

4. The invention in accordance with 2 wherein the head includes intake and exhaust bleed holes in the intake and the exhaust bores.

5. The invention in accordance with 4 wherein the bleed holes of the intake and the exhaust bores each provide a pulsed source of vacuum.

6. The invention in accordance with 5 wherein the bleed holes of the intake and the exhaust bores each further provide a pulsed source of pressure.

7. The invention in accordance with claim 1 wherein the cylinder head is provided with a water jacket to promote cooling of the cylinder head.

8. The invention in accordance with claim 1 wherein the cylinder head is provided with a through bore to accommodate a sparkplug.

9. A method for increasing the compression and reducing harmful emissions from an internal combustion engine, the engine having a removable cylinder head, an intake valve and an exhaust valve, a block portion to which the head is attached, and an intake and an exhaust valve, comprising the acts of:

removing the installed cylinder head from the engine block;

replacing the installed intake and exhaust valves with replacement intake and exhaust valves, the replacement intake and exhaust valves having a circumferential wall extending above the faces of each of the valves;

installing a replacement cylinder head on the engine block, the replacement cylinder head comprising;

a cavity formed as a depression in the head surface bottom side;

an intake valve accommodating bore formed in the replacement cylinder head;

an exhaust valve accommodating bore formed in the replacement cylinder head;

an intake bore liner for fitting into the intake valve accommodating bore; and an exhaust bore liner for fitting into the exhaust valve accommodating bore.

* * * * *